US011151831B1

(12) United States Patent
Adams

(10) Patent No.: US 11,151,831 B1
(45) Date of Patent: Oct. 19, 2021

(54) CARD READER FOR AUGMENTED REALITY GAME SYSTEM

(71) Applicant: Karriem Adams, Milpitas, CA (US)

(72) Inventor: Karriem Adams, Milpitas, CA (US)

( * ) Notice: Subject to any disclaimer, the term of this patent is extended or adjusted under 35 U.S.C. 154(b) by 0 days.

(21) Appl. No.: 16/850,448

(22) Filed: Apr. 16, 2020

Related U.S. Application Data

(60) Provisional application No. 62/870,859, filed on Jul. 5, 2019.

(51) Int. Cl.
*G07F 17/32* (2006.01)

(52) U.S. Cl.
CPC ..... *G07F 17/3209* (2013.01); *G07F 17/3293* (2013.01)

(58) Field of Classification Search
None
See application file for complete search history.

(56) References Cited

U.S. PATENT DOCUMENTS 5,397,133 A * 3/1995 Penzias ..... A63F 1/18 463/22
2008/0032798 A1* 2/2008 Hatamian ..... G07F 17/32 463/42
2009/0209310 A1* 8/2009 Hatamian ..... G07F 17/3293 463/13

* cited by examiner

*Primary Examiner* — Jay Trent Liddle
*Assistant Examiner* — Alex P. Rada, II
(74) *Attorney, Agent, or Firm* — Gulf Coast Intellectual Property Group

(57) ABSTRACT

A card reader for use in an augmented reality poker game wherein the card reader facilitates the participation of a remote player in a card game at a casino. The card reader includes a base member wherein the base member includes an interior volume. A controller is disposed within the interior volume and includes the necessary electronics to receive, store, transmit and manipulate data. The card reader includes a card reading tray that is slidably coupled to the base member and includes an upper surface that is configured to capture and relay image data of a playing card placed thereon. The base member has operably coupled thereto a camera that is secured to a camera mount configured to provide height adjustment of the camera. The camera is operably coupled to the controller and is configured to be manipulated by the remote player engaged with the card reader.

18 Claims, 2 Drawing Sheets

CARD READER FOR AUGMENTED REALITY GAME SYSTEM

PRIORITY UNDER 35 U.S.C Section 119(e) & 37 C.F.R. Section 1.78

This nonprovisional application claims priority based upon the following prior United States Provisional Patent Application entitled: Card Reader for Augmented Reality Game System, Application No. 62/870,859 filed Jul. 5, 2019, in the name of Karriem Adams, which is hereby incorporated by reference for all purposes.

FIELD OF THE INVENTION

The present invention relates generally to gaming systems and apparatus pertaining thereto, more specifically but not by way of limitation, a card reader for use in an augmented reality casino game system wherein the card reader is remotely engaged by a user participating in a casino table game.

BACKGROUND

In the United States the gambling industry is a multi-billion dollar per year industry. While some states have more open regulations than others, most states have at least some form of entertainment wherein it is permissible to bet with the provider or other individuals participating in the activity. Gambling activities include betting on events such as but not limited to horse racing. The most popular form of gambling are casinos wherein casinos provide numerous types of table games ranging from roulette to card games and many others. Casinos are destinations and are not provided in all states. Most states allow some form of online gaming wherein a player can login to a website and play a game such as but not limited to poker and place bets. One of the problems with this is the lack of simulation of reality. Online poker games are software simulations of card games the use algorithms and a software interface to simulate a poker game. These can be financially risky and further do not provide a true poker game experience.

The online gaming industry includes the ability to virtually place bets on games and events but does not provide simulation and an interaction synonymous with attending a facility such as but not limited to a casino. As technology evolves and begins to enter various conventional areas an increase in the ability for a provider to offer an enhanced experience. Augmented reality is an interactive experience of a real world environment. Augmented reality technology is being leveraged in gaming systems such as but not limited to casino gaming systems. In order to provide an augmented reality experience, devices accessible by remote players require to be available and disposed in casinos.

Accordingly, there is a need for an augmented reality device that is configured to be disposed within a casino wherein the device is accessible and controllable by a remote player so as to facilitate the ability for a remote player to play at a table game in a casino.

SUMMARY OF THE INVENTION

It is the object of the present invention to provide an augmented reality device for a casino table game that is operable to provide the ability for a remote player to participate at a table game with a dealer and other players.

Another object of the present invention is to provide an augmented reality card reader configured to be positioned at a player position on a table game in a casino wherein the present invention includes a base member.

A further object of the present invention is to provide an augmented reality device for a casino table game wherein the base member includes electronics disposed therein to receive, store, transmit and manipulate data.

Still another object of the present invention is to provide an augmented reality card reader configured to be positioned at a player position on a table game in a casino wherein the base member further includes a scanner tray movably coupled thereto.

An additional object of the present invention is to provide an augmented reality device for a casino table game wherein the scanner tray is configured to provide images of cards placed thereon to a remote user.

Yet a further object of the present invention is to provide an augmented reality card reader configured to be positioned at a player position on a table game in a casino wherein the base member is configured to receive a camera mount superposed thereon.

Another object of the present invention is to provide an augmented reality device for a casino table game wherein the camera mount includes a fully manipulable camera thereon distal to the base member.

Still an additional object of the present invention is to provide an augmented reality card reader configured to be positioned at a player position on a table game in a casino wherein the camera mount is controllable by the remote user so as to adjust the height thereof.

An alternative object of the present invention is to provide an augmented reality device for a casino table game wherein the present invention further includes microphone and a speaker to provide audio interaction with a dealer at the game table on which the present invention is positioned.

An additional object of the present invention is to provide an augmented reality card reader configured to be positioned at a player position on a table game in a casino wherein the scanner tray is retractable into the base member.

Another object of the present invention is to provide an augmented reality device for a casino table game wherein the camera is operably coupled to the base member.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
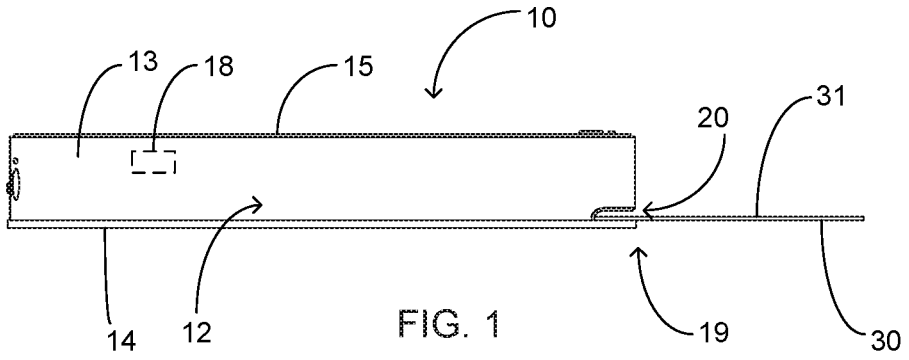
FIG. 1 is side view of the base member of the present invention.
Figure 2:
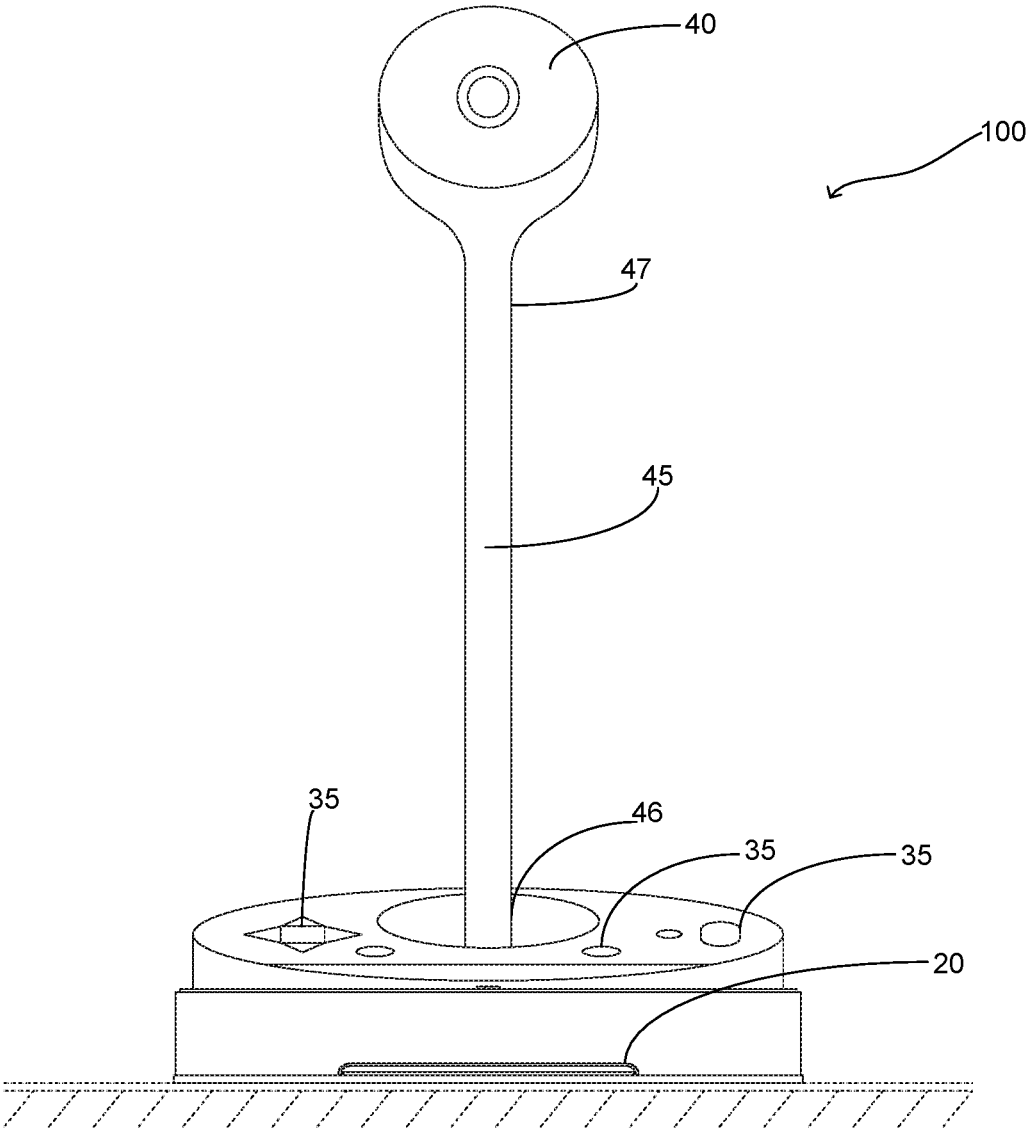
FIG. 2 is a front view of a preferred embodiment of the present invention.

Referring now to the drawings submitted herewith, wherein various elements depicted therein are not necessarily drawn to scale and wherein through the views and figures like elements are referenced with identical reference numerals, there is illustrated a card reader 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to FIG. 1 herein, the card reader 100 includes a base member 10. The base member 10 includes a housing 12 that is manufactured from a durable rigid material such as but not limited to plastic. The housing 12 includes a plurality of walls 13, a bottom 14 and a top 15 integrally formed to create an interior volume. Disposed within the interior volume 15 of the housing is a controller 18 wherein the controller 18 includes the necessary electronics to receive, store, transmit and manipulate data so as to provide operation of the card reader 100 as is further discussed herein. While the base member 10 is illustrated herein as being annular in shape, it should be understood within the scope of the present invention that the base member 10 could be formed in alternate shapes and sizes. It should be additionally understood within the scope of the present invention that the base member 10 could be configured to be rotatable.

A slot 20 is formed in the wall 13 proximate the front 19 of the base member 10. The slot 20 is of suitable size to accommodate the card receiving tray 30, wherein the card receiving tray 30 is slidably coupled to the housing 12 and is movable intermediate a first position and a second position. The card receiving tray 30 in FIG. 1 herein is illustrated in its second position wherein the card receiving tray 30 is extended outward from the housing 12. In its second position, the card receiving tray 30 is operable to have playing cards superposed thereon. In its first position the card receiving tray 30 is retracted into the interior volume of the housing 12. It is contemplated within the scope of the present invention that the card receiving tray 30 could be moved intermediate its first and second position either manually or utilizing automated techniques such as but not limited to an electric motor. The card receiving tray 30 is configured as an optical scanner wherein the upper surface 31 is configured as a conventional optical scanner having a transparent material and using light beams to facilitate the input of data, specifically the indicia present on a playing card that is superposed the upper surface 31. While in the preferred embodiment the card reading tray 30 is configured as an optical scanner, it is contemplated within the scope of the present invention that the card reading tray 30 could employ alternate techniques in order to capture a data image file of a playing card superposed thereon. The card receiving tray 30 is operably coupled to the controller 18 so as to transmit thereto the image of the card placed on the upper surface 31 wherein the controller 18 subsequently transmits a data signal to a remote user of the card reader 100 so as to display thereto. While in the embodiment illustrated herein the card reader 100 utilizes a card reading tray 30 to identify and determine the value of a playing card, it is contemplated within the scope of the present invention that the camera 40 could be utilized in place of and/or in conjunction with the card reading tray 30 to determine the value of a playing card or other game elements such as but not limited to dice. It should be understood that the card reader 100 could have as a part thereof any required software to facilitate the aforementioned regcognition of card and/or dice values.

During utilization of the card reader 100 wherein the card reader 100 has been placed in a position on a table game in a casino, a dealer places playing cards on the upper surface 31 of the card receiving tray 30. The card receiving tray 30 transfers the image data of the playing cards to the controller 18 wherein the controller 18 further transfers the image data to a remote player that is utilizing and controlling the card reader 100. The controller 18 is wirelessly coupled to a conventional communications network such as but not limited to a WiFi network wherein the controller 18 establishes a IP address for the card reader 100 so as to provide communicable coupling of the card reader 100 to the Internet in order for a remote player to gain access to and control of the card reader 100.

The base member 10 includes control interfaces 35 that are conventional interfaces configured to provide either operation and/or engagement with the card reader 100. It is contemplated within the scope of the present invention that the control interfaces 35 could include but are not limited to power button, speaker, audio microphone, volume controls, camera mount controls, electronic connections such as but not limited to USB or micro-USB and auxiliary ports.

Superposed the base member 10 is camera 40. Camera 40 is a conventional high definition camera configured to capture live video data of the area proximate thereto and transfer the video data signal to the controller 18 for subsequent transmission to the remote player operably engaged with the card reader 100. The camera 40 is can be fully manipulated by the remote player engaged therewith wherein the remote player can rotate the camera or move the camera 40 vertically and horizontally so as to be able to capture desired live video data. It should be understood within the scope of the present invention that the camera 40 is operable coupled to the controller 18 utilizing suitable connections such as but not limited to USB or micro-USB. The camera 40 is mounted on the camera mount 45. The camera mount 45 includes a first end 46 and second end 47 wherein the camera 40 is secured to the second end 47. The camera mount 45 is configured to be telescopic so as to facilitate the ability to raise and/or lower the height of the camera 40. The controller 18 provides the remote player the ability to raise and lower the camera 40 through adjustment of the length of the camera mount 45. It should be understood that while not particularly illustrated herein the camera mount 45 would be controlled by an electric motor coupled to the controller 18 facilitating the ability for control thereof by a remote player. It should be further understood within the scope of the present invention that the camera 40 and camera mount 45 could be either permanently or releasably secured to the base member 10. Additionally, it is contemplated within the scope of the present invention that the camera 40 could be utilized to identify and disclose the value of a casino game piece. This could be achieved with an additional camera or the same camera wherein the camera 40 functions as a game piece recognition element in addition to providing a live view of a casino.

Figure 3:
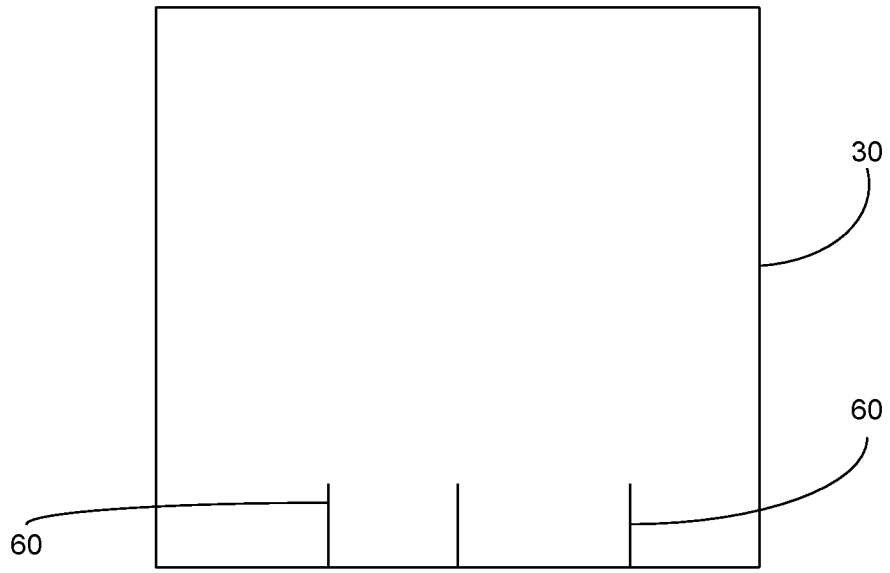
FIG. 3 is a top diagrammatic view of an exemplary embodiment of the card receiving tray of the present invention.
Figure 4:
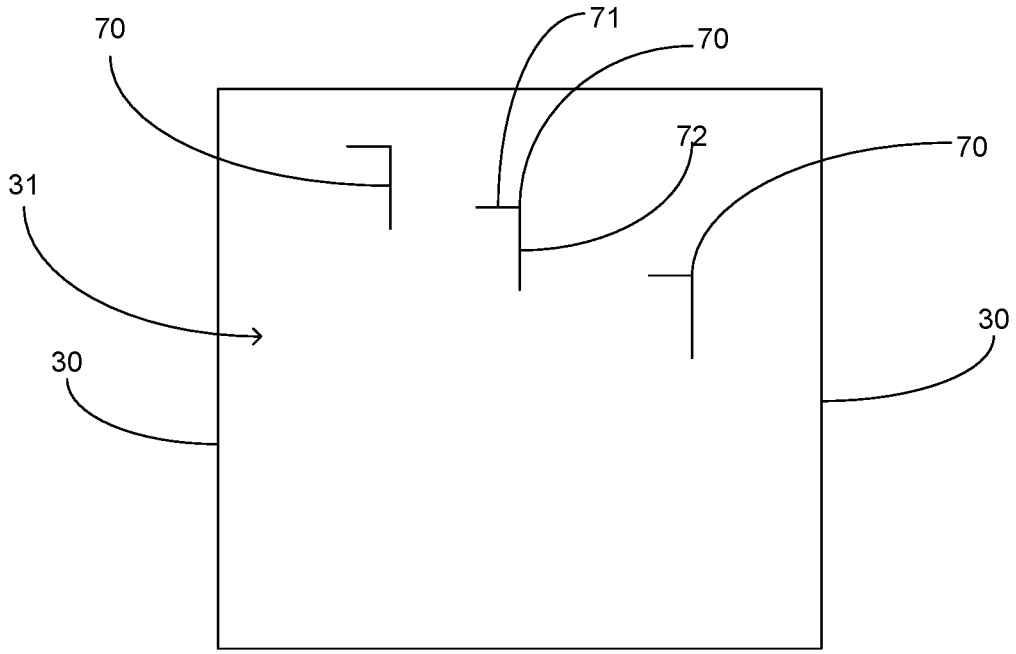
FIG. 4 is a top diagrammatic view of an alternative embodiment of the card receiving tray of the present invention.

Now referring in particular to FIG. 3 and FIG. 4 herein, top diagrammatic views of the upper surface 31 of the card reader 30 are illustrated herein. As has been discussed herein, the card reader 30 is configured as an optical scanner so as to capture data images of playing cards superposed thereon. It is desirable within the scope of the present invention to provide a card reading tray 30 that can accommodate a plurality of playing cards at a single time wherein the remote player receives a image data file that clearly shows the indicia on each card showing the value thereof. As is known in the art, playing cards have the value indicia proximate the lateral edges thereof. In order to assist in proper placement of the playing cards the card reading tray 30 is provided in several alternative embodiments. In FIG. 3, the upper surface 31 is illustrated having the card placement markers 60 formed thereon. The card placement markers 60 identify where a dealer should place a card and have a lateral edge in general alignment therewith. It is contemplated within the scope of the present invention that the card placement markers 60 could be a formed by a groove or by a suitable marking. It is further contemplated within the scope of the present invention that the upper surface 31 could have various quantities of card placement markers 60 depending on the size of the card reading tray 30. It is additionally contemplated within the scope of the present invention that the card placement markers 60 could extend various lengths along the upper surface 31 of the card reading tray 30.

Referring in particular to FIG. 4, the card reading tray 30 is illustrated therein having card placement keepers 70 on the upper surface 31 thereof. The card placement keepers 70 are manufactured from a durable rigid material such as but not limited to plastic. The card placement keepers 70 are secured to the upper surface 31 utilizing suitable techniques and include a first member 71 and second member 72 integrally formed. The first member 71 and second member 72 are perpendicular to each other so as to mateably receive a corner of a playing card and provide alignment thereof on the upper surface 31. The card placement keepers 70 are placed in an offset alignment as illustrated herein so as to provide visibility and alignment of multiple playing cards if placed on the upper surface 31. It should be understood within the scope of the invention that the card reading tray 30 would vary in size in order to accommodate single card or multi-card play thereon. It should be further understood within the scope of the present invention that the card reader 100 could be powered by various conventional power sources such as but not limited to batteries and/or AC electrical power.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A poker card reading device for use in an augmented reality poker game comprising:

a housing, said housing having at least one wall configured to form an interior volume, said housing configured to be superposed a game table;

a controller, said controller being configured to receive, transmit, manipulate and store data, said controller being wirelessly coupled to a computer network so as to provide remote access to the poker card reading device;

a camera, said camera being mounted within said housing, said camera being operably coupled to said controller, said camera configured to capture video data and transmit to said controller;

a camera mount, said camera mount being operably coupled intermediate said housing and said camera, said camera mount configured to provide movement of said camera; and a game piece recognition element, said game piece recognition element configured to recognize game pieces of a poker game and a value thereof, wherein said game piece recognition element is movable intermediate a first position and a second position.

2. The poker card reading device as recited in claim 1, wherein said game piece recognition element is an optical scanner.

3. The poker card reading device as recited in claim 2, wherein said housing further includes a receiving element formed therein, said receiving element configured to receive a poker game piece in order to initiate identification thereof.

4. The poker card reading device as recited in claim 3, wherein in said first position said game piece recognition element is substantially disposed within the interior volume of said housing.

5. The poker card reading device as recited in claim 4, and further including a plurality of control interfaces, said plurality of control interfaces configured to provide operation of the poker card reading device.

6. A poker card reading device for use in an augmented reality poker game wherein the poker card reading device facilitates participation of a remote player in a card game at a casino wherein the poker card reading device comprises:

a base member, said base member including a housing, said housing having a wall, a bottom and a top configured to form an interior volume, said housing having a slot formed in the wall thereof, said base member configured to be superposed a game table;

a controller, said controller being configured to receive, transmit, manipulate and store data, said controller being wirelessly coupled to a computer network so as to provide remote access to the poker card reading device;

a camera, said camera being mounted to said base member, said camera being operably coupled to said controller, said camera being configured to be movable so as to control a direction thereof, said camera operably secured to a camera mount, said camera mount being coupled to said base member, said camera mount configured to adjust a vertical position of the camera;

a card reading tray, said card reading tray being slidably mounted to said base member within said slot, said card reading tray configured to have at least one poker card superposed thereon, said card reading tray configured to be slidable intermediate a first position and a second position, said card reading tray operable to capture an image data file of the at least one poker card and transfer to said controller.

7. The poker card reading device for use in an augmented reality poker game as recited in claim 6, wherein in said first position said card reading tray is substantially disposed within the interior volume of said housing of said base member.

8. The poker card reading device for use in an augmented reality poker game as recited in claim 7, wherein in said second position said card reading tray is extended outward from said housing of said base member.

9. The poker card reading device for use in an augmented reality poker game as recited in claim 8, and further including a microphone and a audio speaker, said microphone and audio speaker operably coupled to said controller, said microphone and audio speaker operable to transmit voice data intermediate the remote player and at least one individual proximate the poker card reading device.

10. The poker card reading device for use in an augmented reality poker game as recited in claim 9, and further including at least one card placement marker, said at least one card placement marker being present on an upper surface of the card reading tray.

11. The poker card reading device for use in an augmented reality poker game as recited in claim 10, and further including a plurality of control interfaces, said plurality of control interfaces configured to provide operation of the poker card reading device.

12. The poker card reading device for use in an augmented reality poker game as recited in claim 11, wherein said card reading tray is configured as an optical scanner.

13. A poker card reading device for use in an augmented reality poker game wherein the poker card reading device facilitates participation of a remote player in a card game at a casino wherein the poker card reading device comprises:

a base member, said base member including a housing, said housing having a wall, a bottom and a top configured to form an interior volume, said base member being annular in shape, said housing having a slot formed in the wall thereof proximate a front portion of the base member, said base member configured to be superposed a game table;

a controller, said controller being disposed within the interior volume of said housing, said controller being configured to receive, transmit, manipulate and store data, said controller being wirelessly coupled to a computer network so as to provide remote access to the poker card reading device for the remote player;

a camera, said camera being mounted to said base member, said camera being operably coupled to said controller, said camera being configured to be movable so as to control a direction thereof, said camera operably secured to a camera mount, said camera mount having a first end and a second end wherein the camera is secured to said second end, said camera mount being coupled to said base member, said camera mount configured to adjust a vertical position of the camera;

a card reading tray, said card reading tray being slidably mounted to said base member within said slot of said housing, said card reading tray having an upper surface configured to have at least one poker card superposed thereon, said card reading tray configured to be slidable intermediate a first position and a second position, wherein in said first position said card reading tray is disposed within the interior volume of said housing, said card reading tray operable to capture an image data file of the at least one poker card and transfer to said controller.

14. The poker card reading device for use in an augmented reality poker game as recited in claim 13, and further including a microphone and a audio speaker, said microphone and audio speaker operably coupled to said controller, said microphone and audio speaker operable to transmit voice data intermediate the remote player and at least one individual proximate the poker card reading device.

15. The poker card reading device for use in an augmented reality poker game as recited in claim 14, and further including at least one card placement keeper, said at least one card placement keeper configured to provide alignment of a poker card on the upper surface of the card reading tray.

16. The poker card reading device for use in an augmented reality poker game as recited in claim 15, wherein in said second position said card reading tray is extended outward from said housing of said base member.

17. The poker card reading device for use in an augmented reality poker game as recited in claim 14, and further including at least one card placement marker, said at least one card placement marker being present on an upper surface of the card reading tray.

18. The poker card reading device for use in an augmented reality poker game as recited in claim 14, wherein said card reading tray is configured as an optical scanner.

* * * * *